US009359751B2

(12) United States Patent
Beaumont

(10) Patent No.: US 9,359,751 B2
(45) Date of Patent: Jun. 7, 2016

(54) PLUMBING TRAP FLUSHING DEVICE

(71) Applicant: Boemar Inc.

(72) Inventor: Bart Donald Beaumont, San Diego, CA (US)

(73) Assignee: BOEMAR INC., Road Town, Tortola (VG)

( * ) Notice: Subject to any disclaimer, the term of this patent is extended or adjusted under 35 U.S.C. 154(b) by 0 days.

(21) Appl. No.: 14/806,886

(22) Filed: Jul. 23, 2015

(65) Prior Publication Data

US 2016/0083945 A1 Mar. 24, 2016

Related U.S. Application Data

(63) Continuation of application No. 12/695,890, filed on Jan. 28, 2010, now abandoned.

(51) Int. Cl.
*E03D 9/00* (2006.01)
*E03C 1/306* (2006.01)

(52) U.S. Cl.
CPC .. *E03C 1/306* (2013.01); *E03D 9/00* (2013.01)

(58) Field of Classification Search
CPC ..... E03C 1/306; E03D 9/00
USPC ..... 4/255.01, 255.04–255.09
See application file for complete search history.

(56) References Cited

U.S. PATENT DOCUMENTS

| | | | |
|---|---|---|---|
| 1,331,018 | A | 2/1920 | Luthy |
| 2,283,780 | A | 5/1942 | Ahern |
| 2,315,673 | A | 4/1943 | Taylor |
| 2,735,794 | A | 2/1956 | Pletcher |
| 3,526,547 | A | 9/1970 | Shock |
| 3,535,161 | A | 10/1970 | Gutrich |
| 4,257,139 | A | 3/1981 | Yeo |
| 5,222,533 | A | 6/1993 | Porter, Jr. |
| 5,253,664 | A | 10/1993 | Wilson |
| 5,497,514 | A | 3/1996 | Miller |
| 2005/0028259 | A1 | 2/2005 | Buchanan et al. |
| 2005/0050624 | A1 | 3/2005 | Pangramuyen |

FOREIGN PATENT DOCUMENTS

WO 2011094636 A1 8/2011

*Primary Examiner* — Tuan N Nguyen
(74) *Attorney, Agent, or Firm* — Hill & Schumacher

(57) ABSTRACT

A plumbing trap flushing device for use in association with one of a drain in a sink, an overflow drain in a basin, a drain in a bathtub, an overflow drain in a bathtub and the like is disclosed. The plumbing trap flushing device includes a connector, a conduit and a nozzle. The connector is releasably attachable to a tap. The conduit is in flow communication with the connector and has an outside diameter and an inside diameter. The outside diameter is dimensioned to fit into the drain, whereby when the conduit is in the drain air and water freely flows around the conduit into the drain. The nozzle is in flow communication with the distal end of the conduit. The nozzle has a nozzle inside diameter less than the inside diameter of the conduit whereby the water exits the nozzle in a stream.

23 Claims, 19 Drawing Sheets

PLUMBING TRAP FLUSHING DEVICE

FIELD OF THE INVENTION

This invention relates to plumbing trap flushing devices and in particular to plumbing trap flushing devices that are connectable to a tap or liquid supply of hot and/or cold water.

BACKGROUND OF THE INVENTION

It is a common problem for traps and drains in a house to get blocked. In the kitchen they will often get blocked with coffee grounds, food and other debris that are washed down the drain when cleaning the dishes and the sink. In the bathroom hair and other debris will often clog the basin. Home owners often try to unclog the trap by pouring chemicals down the drain. While this may be successful in the short term these chemicals, if effective, will likely overtime degrade the integrity of the trap and drain pipes, as well as being harmful to the environment.

Alternatively, a number of gadgets have been suggested that can be used to unclog the trap but they have only limited success. For example there are some devices that are attachable to a tap for delivering pressurized water into the trap. However, typically these devices anticipate dislodging the clog by building up pressure behind the clog and essentially forcing the clog through the drain. In order to operate such a device it is intended that the drain to the trap be sealed around the device so that pressure can build up and it is the build-up of pressure that forces the clog through the trap. The problem with this approach is that in order to create enough pressure to push the clog through the trap the pressure would likely exceed the allowable pressures for the pipe, the joints and/or the fittings. Thus using such devices over time would likely degrade the pipe. As well, many of these devices have complex nozzles that may be prone to catching on the drains in the traps when being inserted and removed from the traps. Alternatively many of these devices have nozzles that only fit into the top of the trap and thus do not deliver the water directly to the clog.

Accordingly, it would be advantageous to provide a plumbing trap flushing device that is easy to use and does not rely on pressure build-up in the trap.

SUMMARY OF THE INVENTION

The present invention relates to a trap flushing device for use in association with one of a drain in a sink, an overflow drain in a basin, a drain in a bath tub, an overflow drain in a bath tub and the like. The plumbing trap flushing device includes a connector, a conduit and a nozzle. The connector is releasably attachable to a tap. The conduit is in flow communication with the connector and has an outside diameter and an inside diameter. The outside diameter is dimensioned to fit into the drain, whereby when the conduit is in the drain liquid and air is capable of freely flowing around the conduit into the drain. The nozzle is in flow communication with the distal end of the conduit. The nozzle has a nozzle inside diameter less than the inside diameter of the conduit whereby the water exits the nozzle in a stream.

Further features of the invention will be described or will become apparent in the course of the following detailed description,

BRIEF DESCRIPTION OF THE DRAWINGS

The invention will now be described by way of example only, with reference to the accompanying drawings, in which.

DETAILED DESCRIPTION OF THE INVENTION

Figure 1:
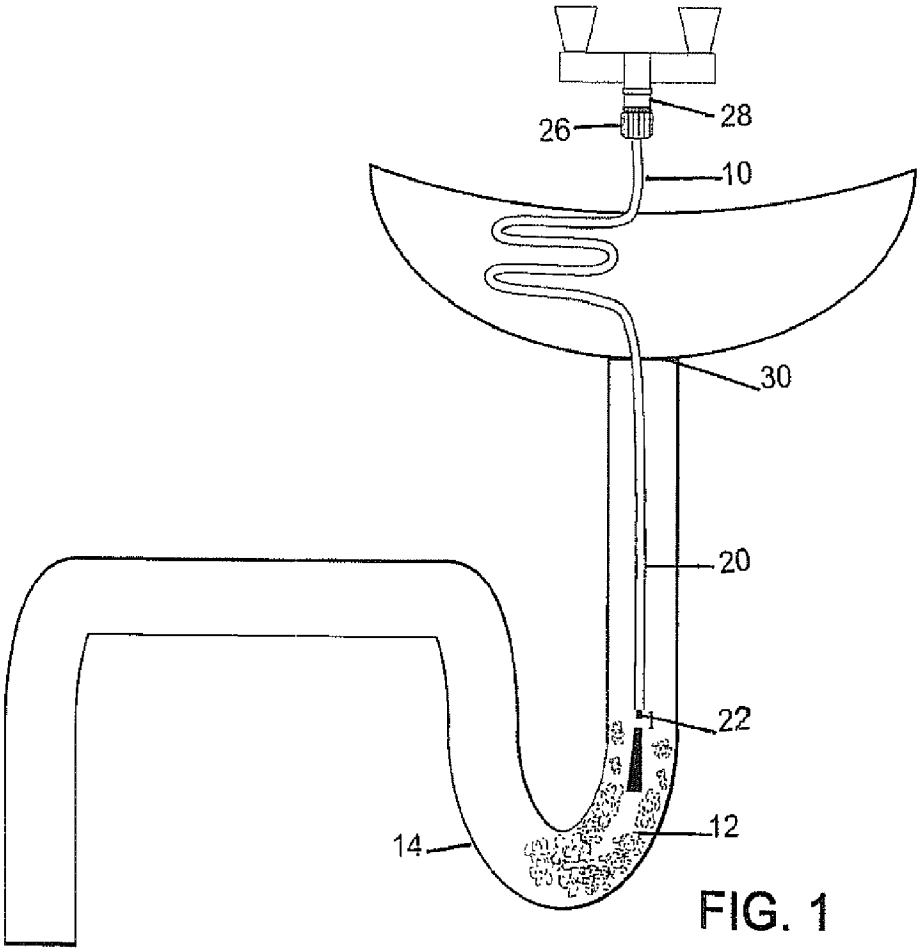
FIG. 1 is a cross-sectional view of the plumbing trap flushing device of the present invention showing a clog at the beginning of the bend of the trap.
Figure 2:
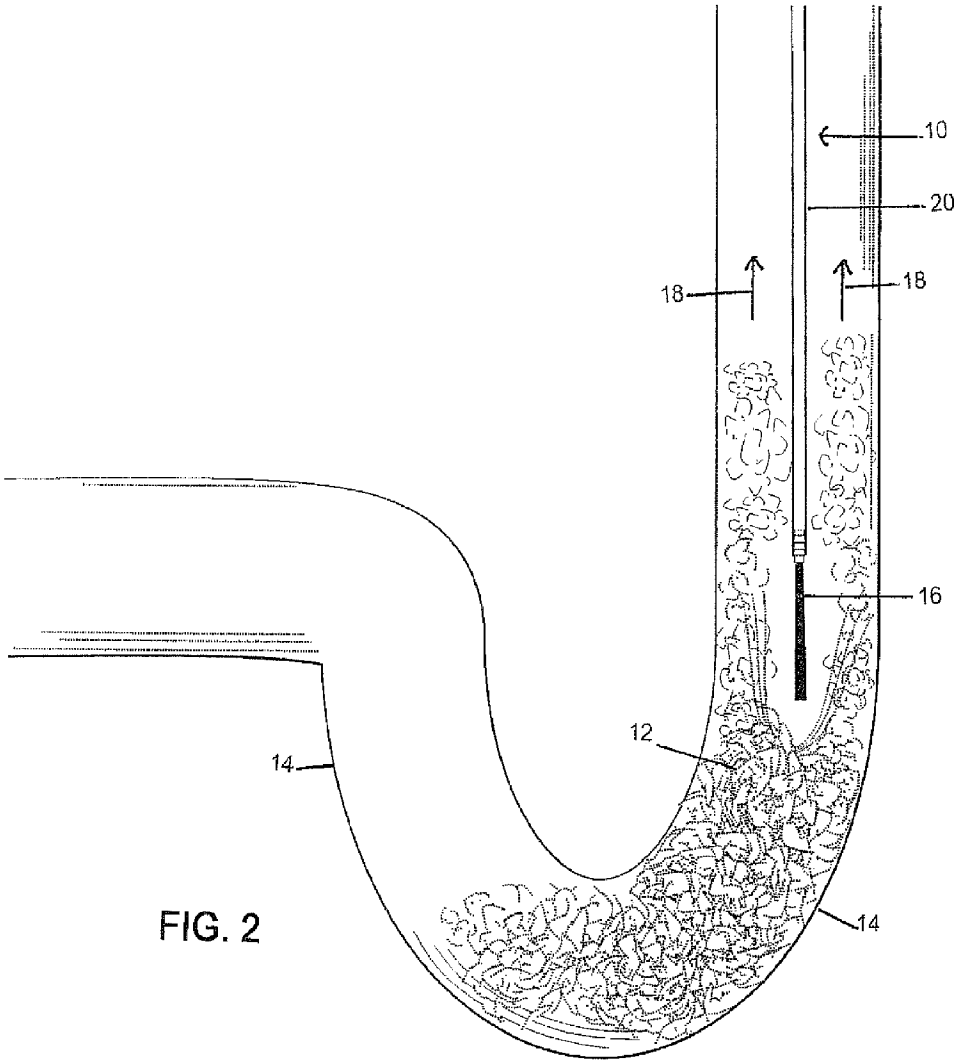
FIG. 2 is an enlarged cross-sectional view similar to that shown in FIG. 1 and showing a portion of the bend of the trap.

FIGS. 1 and 2 show the plumbing trap flushing device 10 of the present invention as it works to dislodge a clog 12 in the trap 14. FIG. 2 is an enlarged view showing a portion of the trap 14 and the water jet 16 from the plumbing trap flushing device 10 beginning to break up the clog 12. The water jet 16 shoots water under pressure into the clog, dislodging some of the clog which moves upwardly as shown by arrows 18.

Figure 3:
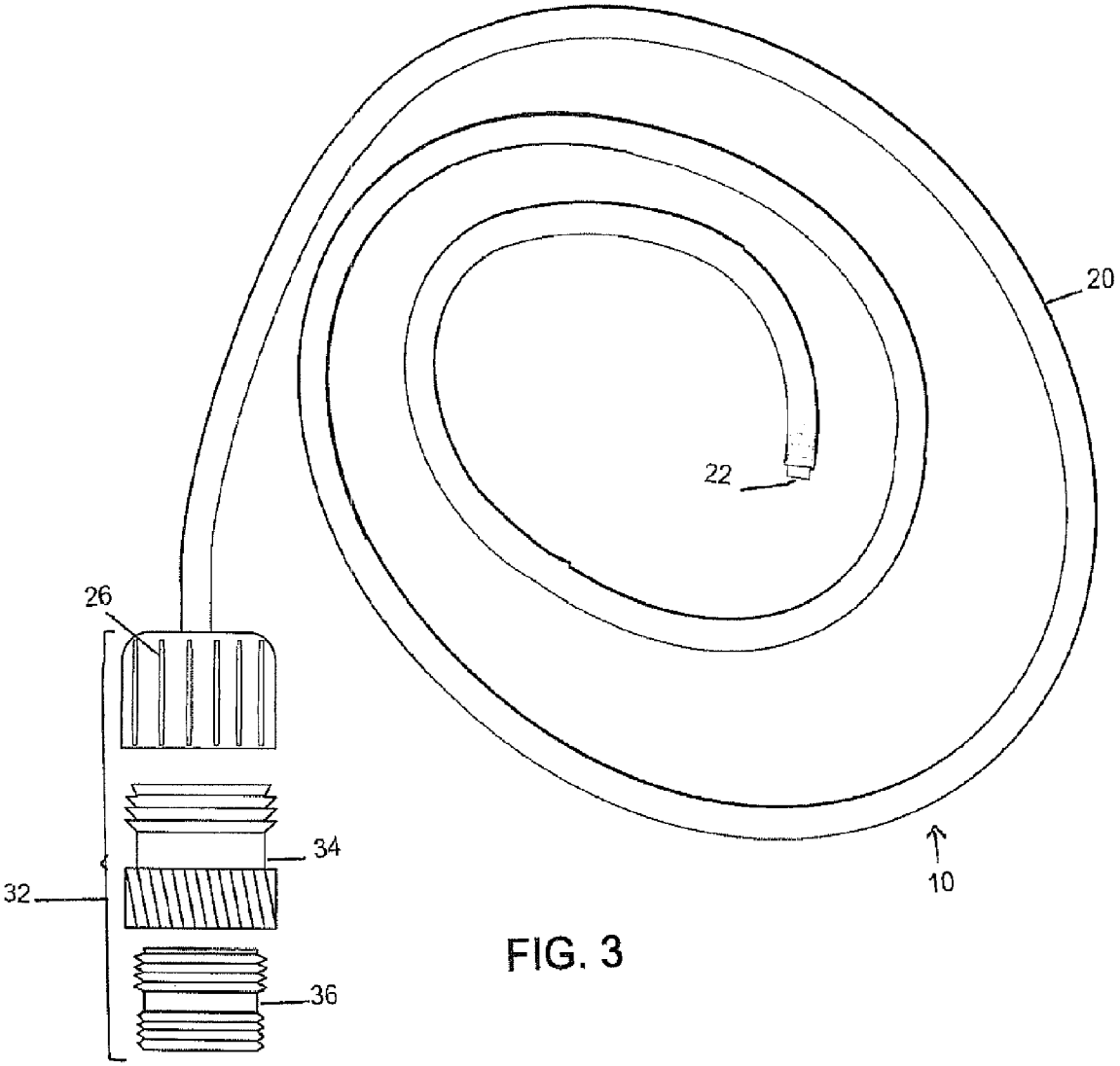
FIG. 3 is an enlarged side view of the plumbing trap flushing device of the present invention.

Referring to FIG. 3, the plumbing trap flushing device 10 includes a flexible conduit 20 having a connector 26 attached thereto, and the connector 26 is releasably connectable to the tap above the sink. The conduit 20 is insertable into a drain as shown in FIGS. 1 and 2. The conduit 20 is in flow communication with the connector 26. The conduit 20 has an outside diameter and an inside diameter, the outside diameter is dimensioned to fit into the drain. When the conduit 20 is in the drain air and liquid freely flows around the conduit into the drain such that pressure cannot build up within the pipe. The conduit includes a nozzle end portion 22 for increasing pressure of the liquid in the conduit and producing a water jet at the exit of the nozzle end portion 22. Preferably, the nozzle end portion 22 has an outer diameter that is generally the same as or less than the outer diameter of the conduit. This reduces the changes of the nozzle end portion catching on the drain strainer 30 which is at the mouth of the trap 14.

A connector 26 is attached to conduit 20 at the opposing end of the conduit from the nozzle end portion 22. The connector 26 is adapted to connect the plumbing trap flushing device 10 to a tap 28 such that the conduit is in flow communication with the connector 26 and, in turn, to the tap 28.

In use the connector 26 is attached to a tap 28. The nozzle end portion 22 of the conduit 20 is fed through the drain strainer 30 and into the trap 14. The water is turned on and because of the decreased diameter at the nozzle 22 there is an increased water pressure at the nozzle such that water exits the nozzle in a jet. It is the force from the water jet 16 that works to break up the clog. As the clog is broken up debris from the clog moves upwardly in the trap and may enter the sink or tub. Once a path is created through the clog the water drain taking the remainder of the debris in the clog and any debris that may have backed up with it.

Figure 4:
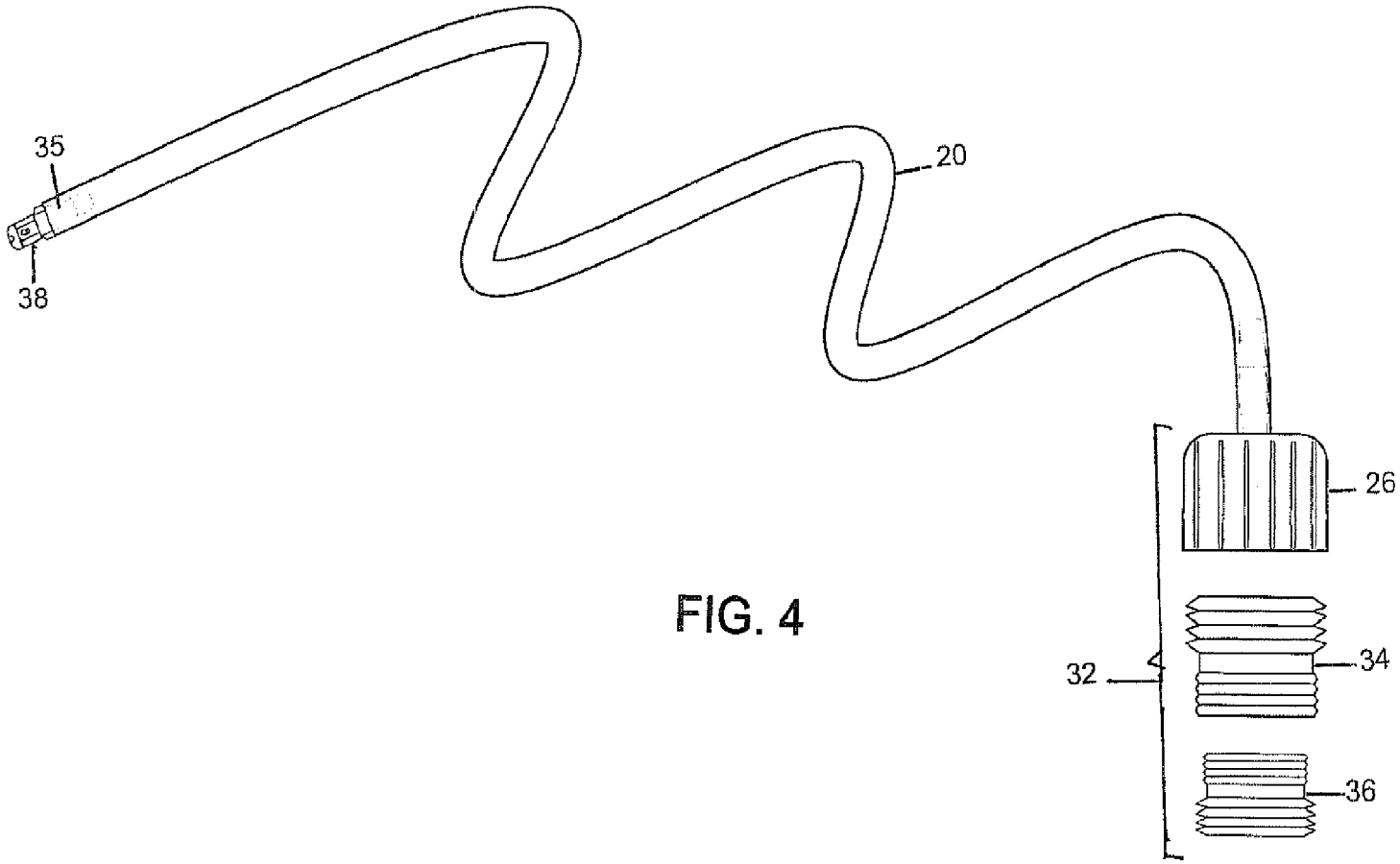
FIG. 4 is an enlarged side view of the plumbing trap flushing device of the present invention similar to that shown in FIG. 3 but showing a different nozzle positioned therein.

There are a number of variations or enhancements that may be used to add to the embodiments described above. Specifically as shown in FIGS. 3 and 4 the connector 26 may be a universal connector 32 which include a connector adaptor 34 and a connector insert 36. As can be seen in FIGS. 3 and 4 the connector adaptor 34 and the connector insert 36 may vary depending on the threads of the tap to which it is being attached. Accordingly, the universal connector 32 allows the plumbing trap flushing device 10 to be connectable to a variety of different sized taps 28.

Figure 5:
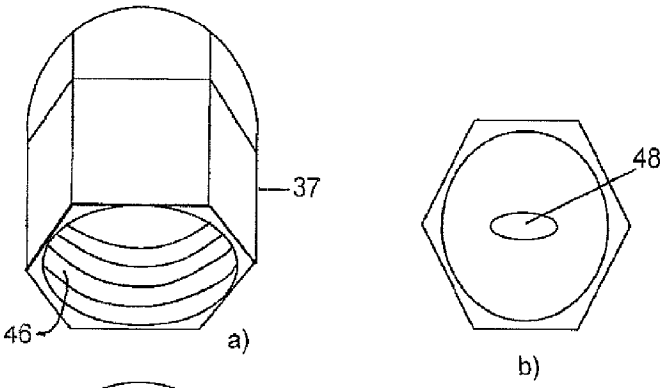
FIG. 5 a) is a perspective view, b) is a top view and c) is a side view of an embodiment of a nozzle for the plumbing trap flushing device of the present invention.
Figure 6:
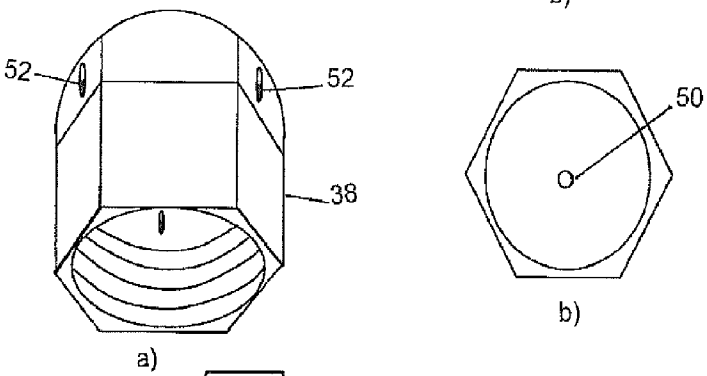
FIG. 6 a) is a perspective view, b) is a top view and c) is a side view of an alternate embodiment of a nozzle for the plumbing trap flushing device of the present invention.
Figure 7:
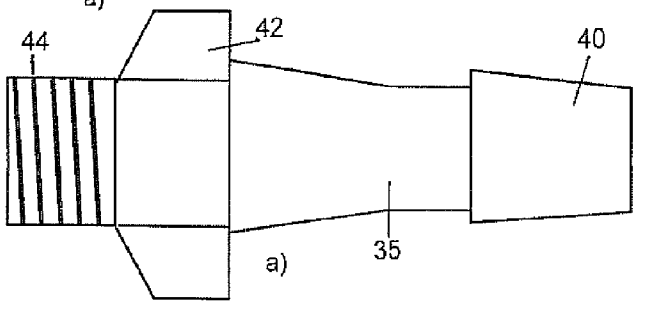
FIG. 7 a) is a side view and b) is a top view of a nozzle adaptor for use in association with the nozzles of FIGS. 5 and 6.

Nozzle 22 may have a number of different configurations. For example it may be a simple nozzle as shown in FIG. 3 wherein the conduit 20 has an insert that effectively reduces the diameter of the end of the conduit. Alternatively as shown in FIG. 4 the nozzle 38 may be somewhat more elaborate. Some examples of different various nozzles are shown in FIGS. 5 and 6 and a nozzle adaptor is shown in FIG. 7. In use the nozzle adaptor 35 shown in FIG. 7 is inserted into the distal end of conduit 20 as shown in FIG. 4 and a nozzle is then attached to the nozzle adaptor 35. Two examples of interchangeably nozzles that may be attached to the nozzle adaptor 35 are shown at 37 and 38 in FIGS. 5 and 6 respectively. Nozzle adaptor 35 includes an insertion portion 40, a stop portion 42 and a threaded portion 44. The interchangeable nozzles are attached to the threaded portion. As shown in FIG. 7 the insertion portion 40 is inserted in the conduit 20 until it hits the stop portion 42 and then a nozzle is attached to the threaded portion.

Figure 15:
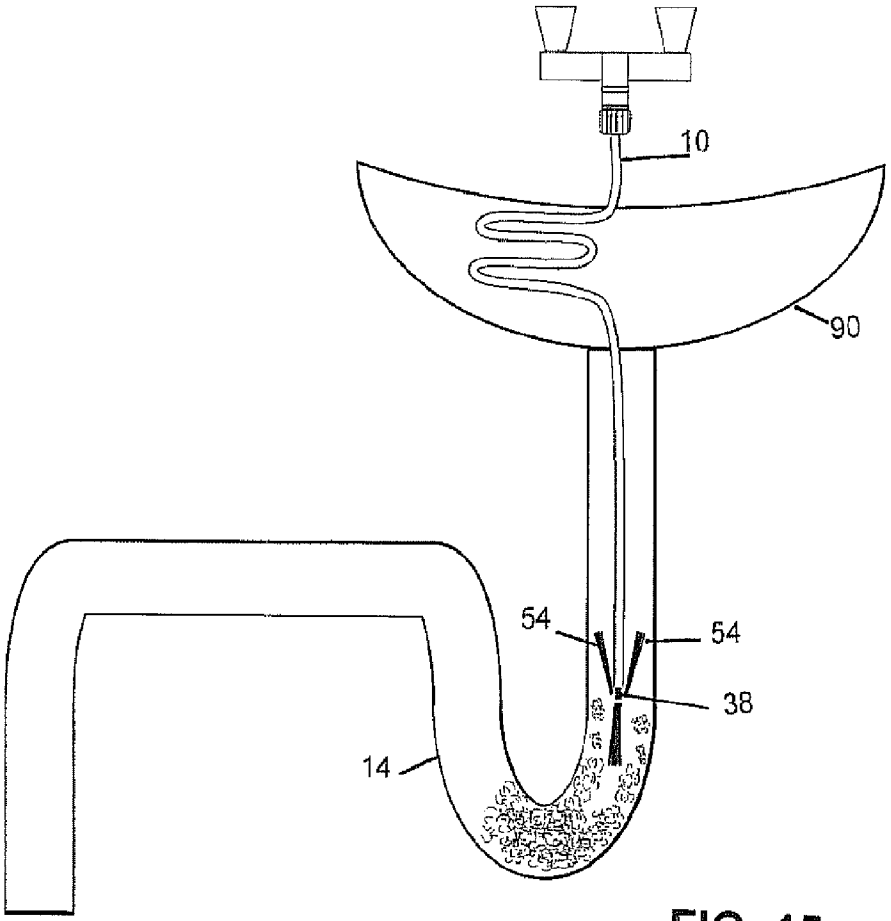
FIG. 15 is a cross-sectional view similar to that shown in FIG. 1 but showing the spray from an alternate nozzle.

Two examples of interchangeable nozzles that are attachable to the nozzle adaptor 35 are shown in FIGS. 5 and 6. Interchangeable nozzle 37 shown in FIG. 5 has an internal thread 46 and a central jet hole 48. In this embodiment the jet hole 48 is oval in shape. Interchangeable nozzle 38 shown in FIG. 6 is similar to nozzle 37 but in addition to a central jet hole 50 it has a plurality of side holes 52. Side holes 52 are shaped so as to produce side jets 54 (as seen in FIG. 15). Preferably side jets are angled backwardly such that the side jets shoot water out at an angle sideways and backwardly. This embodiment has the advantage that the side jets may serve to help pull the plumbing trap flushing device through the trap into the drain. As well the side jets can help to clean the inside of the pipe.

Figure 8:
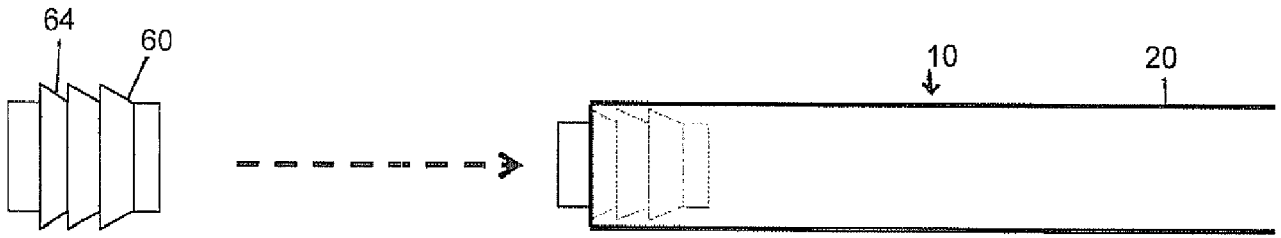
FIG. 8 is an enlarged side view of another embodiment of a nozzle for a plumbing trap flushing device.
Figure 9:
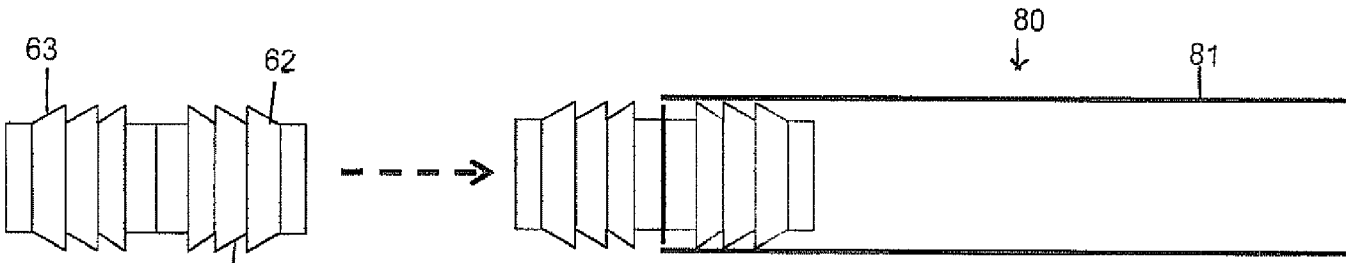
FIG. 9 is an enlarged side view of an alternate nozzle similar to that shown in FIG. 8 but for use with the plumbing drain flushing device.
Figure 10:
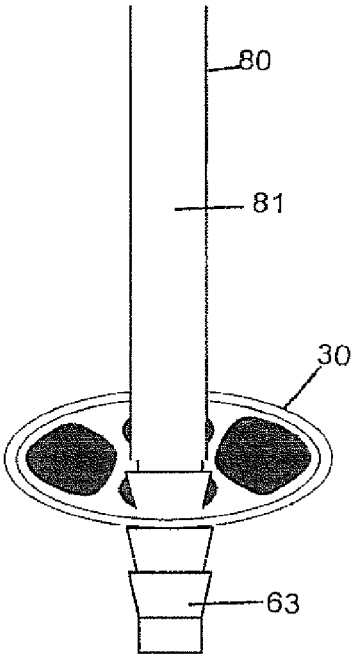
FIG. 10 is a perspective view of the plumbing drain flushing device of FIG. 9 showing the nozzle hooked onto the drain strainer.

FIGS. 8 and 9 show nozzles 60 and 62 respectively. Nozzle 60 is for use in association with plumbing trap flushing device 10 and is insertable into the conduit 20. In another embodiment of the invention there is provided a larger drain flushing device 80 which can also be seen in FIGS. 10. 19 and 21. Plumbing drain flushing device 80 essentially works the same way as the plumbing trap flushing device but it includes a flexible conduit 81 that is larger than conduit 20 and would thus be difficult to fit into some drains and in particular pop-up drains. Nozzle 62 is for use in association with plumbing drain flushing device 80. Nozzles 60, 62 each have a saw tooth outer surface 64 to facilitate insertion into the conduit 20 and 81 respectively and are designed to make it difficult to remove from the respective conduits. Nozzle 62 also includes a reverse saw tooth 63 which is adapted to catch onto a drain strainer 30 as shown in FIG. 10.

Figure 12:
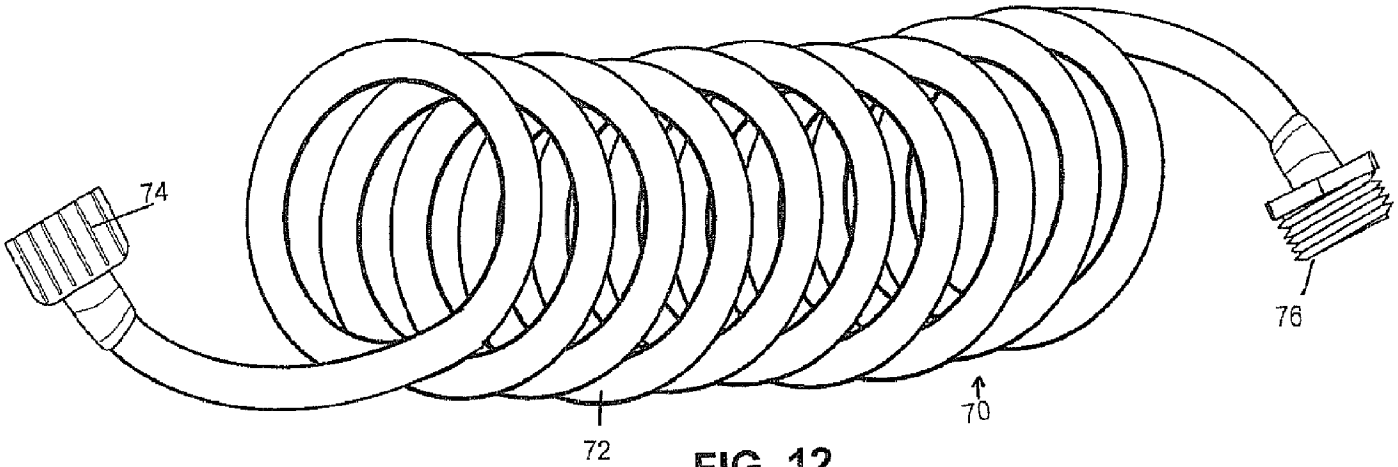
FIG. 12 is a side view of an alternate water supply extension similar to that shown in FIG. 11 but with a self coiling conduit.
Figure 11:
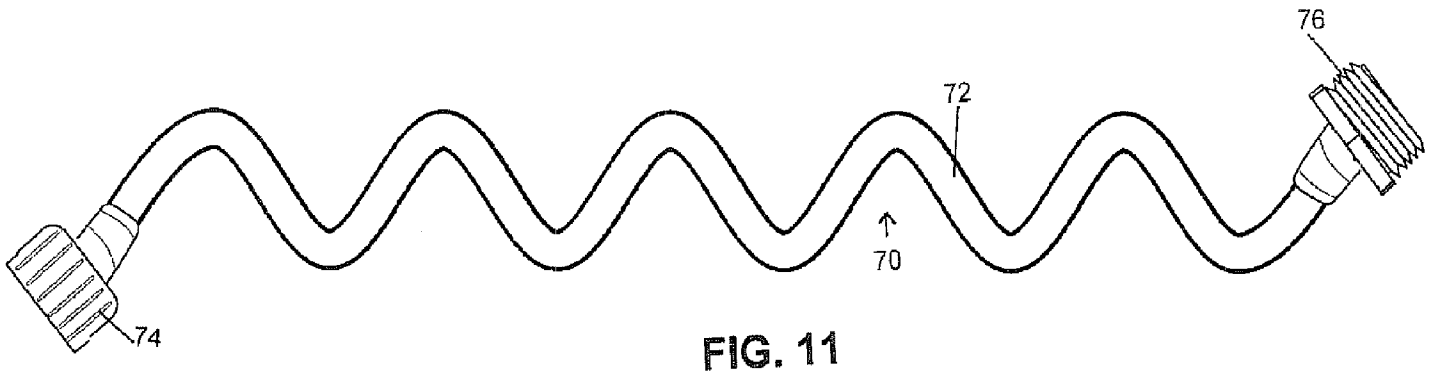
FIG. 11 is a side view of a water supply extension adapted to be attached to the plumbing trap flushing device of the present invention.
Figure 13:
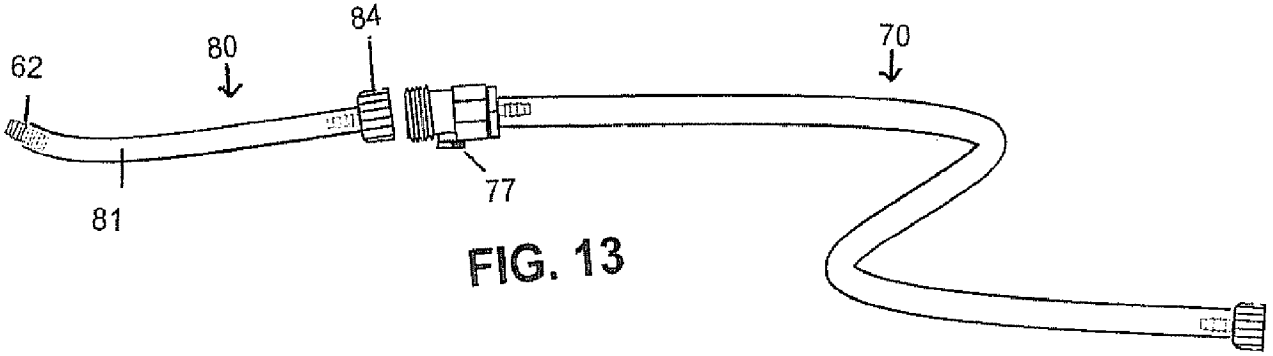
FIG. 13 is a side view of the plumbing drain flushing device attached to the water supply extension.
Figure 14:
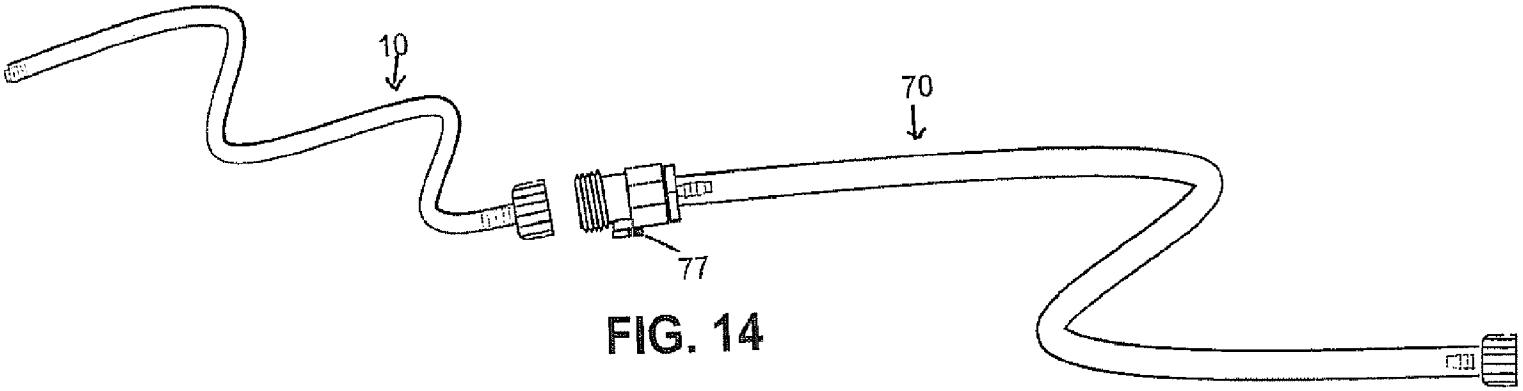
FIG. 14 is a side view of the plumbing trap flushing device attached to the water supply extension.

The plumbing trap flushing device 10 may be attached to a water supply extension 70 shown in FIGS. 11 and 12. Water supply extension 70 includes a flexible conduit 72, a connector 74 at one end thereof adapted to be connected to a tap and a connector 76 at the other end thereof adapted to be connected to the plumbing trap flushing device as shown in FIG. 14 or a plumbing drain flushing device as shown in FIG. 13. Flexible conduit may be self coiling as shown in FIG. 12. Connector 76 may also include a shut off valve 77 as shown in FIGS. 13 and 14. It will be appreciated by those skilled in the art that preferably the valve is one that is easily moved from fully open to fully closed. One such valve is a full bore ball valve quarter turn shut off valve.

Figure 19:
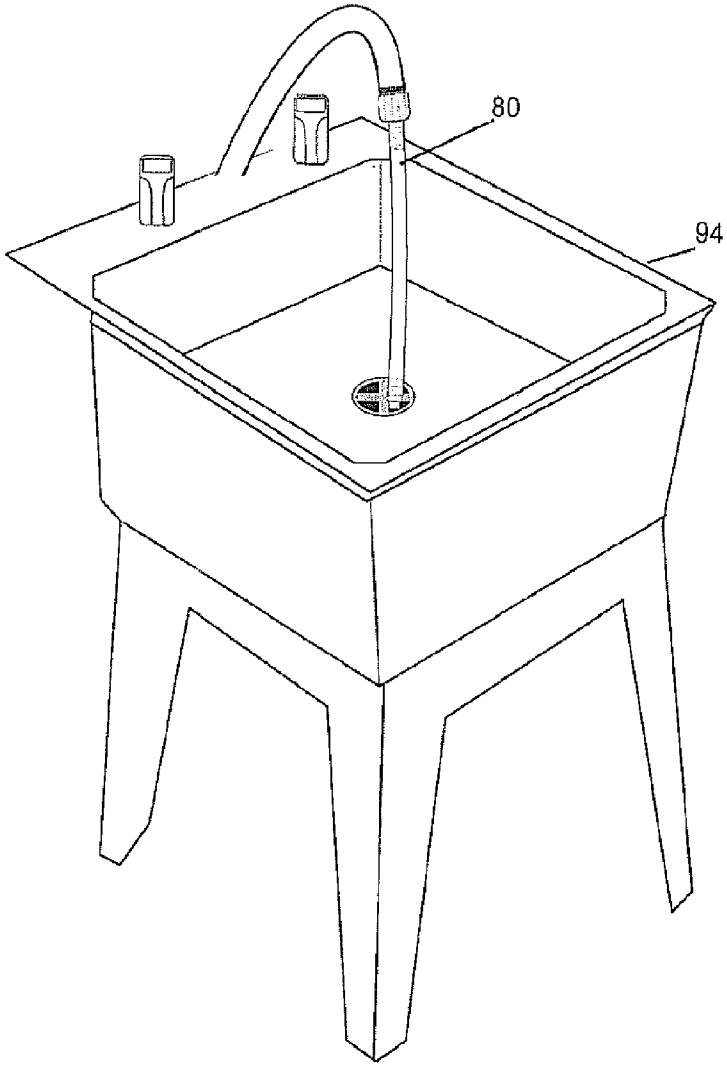
FIG. 19 is a perspective view of the plumbing drain flushing device of the present invention used in a laundry tub.
Figure 20:
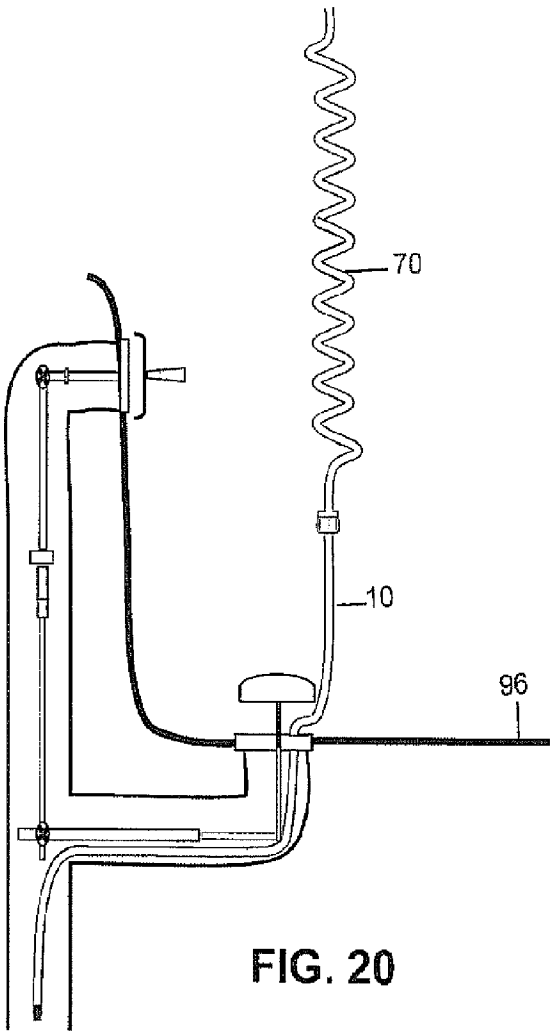
FIG. 20 is a cross-sectional view of the plumbing trap flushing device used in a pop up drain in a tub.
Figure 21:
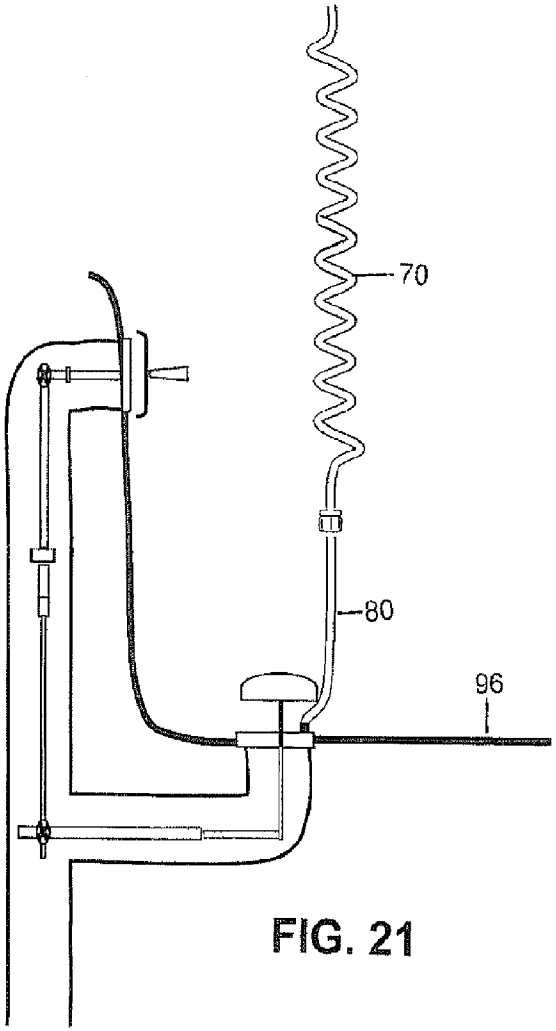
FIG. 21 is a cross-sectional view of the plumbing drain flushing device used in a pop up drain in a tub.

A plumbing drain flushing device 80 is shown in FIG. 13. The drain flushing device 80 may also be attached to the water supply extension 70. The drain flushing device is similar to the trap flushing device and it includes a conduit 81, a connector 84 and a nozzle 62. The drain flushing device has a larger outside diameter than the trap flushing device. The drain flushing device is dimensioned to be positioned at the edge of a drain and to shoot a jet of water down the drain as shown in FIGS. 19 and 21.

Figure 16:
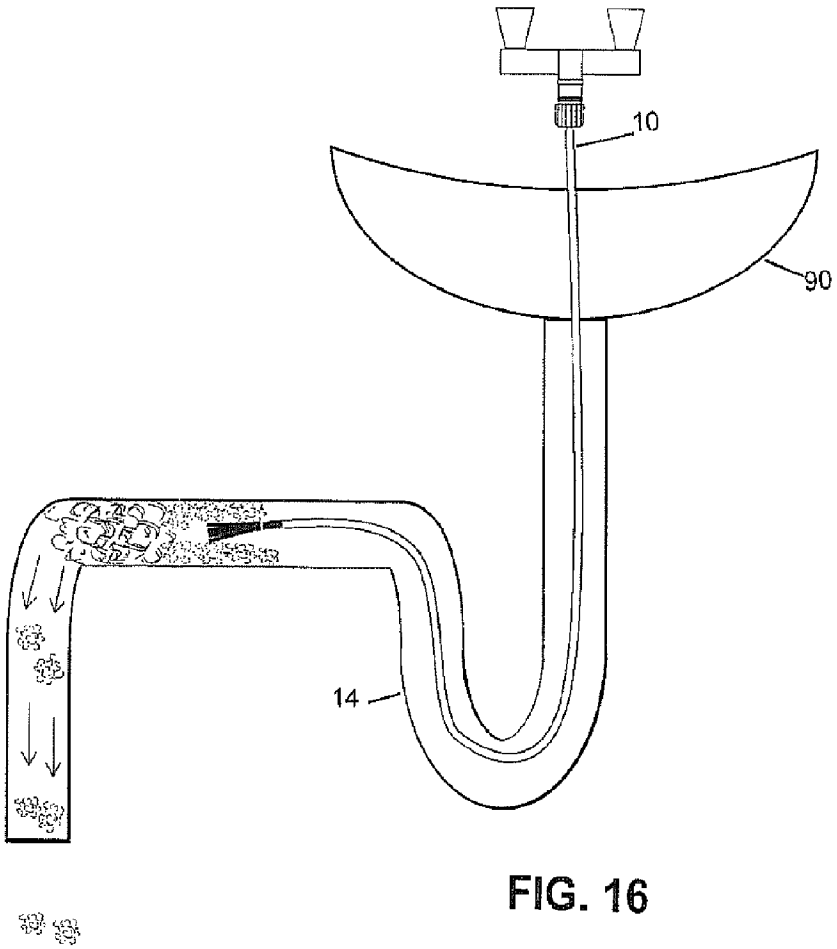
FIG. 16 is a cross-sectional view similar to that shown in FIG. 1 but showing the clog moving through the trap and going through the end of the bend of the trap.
Figure 17:
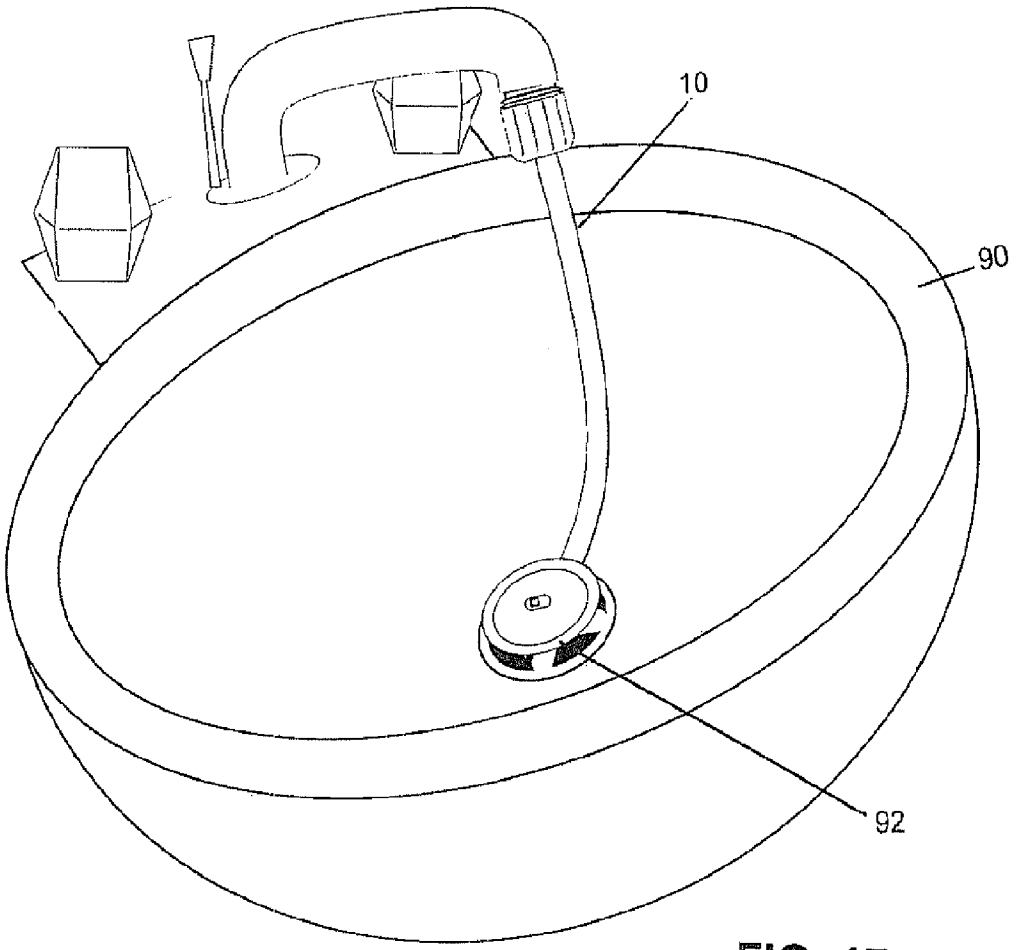
FIG. 17 is a perspective view of the plumbing trap flushing device of the present invention used in a pop up drain in a basin.
Figure 18:
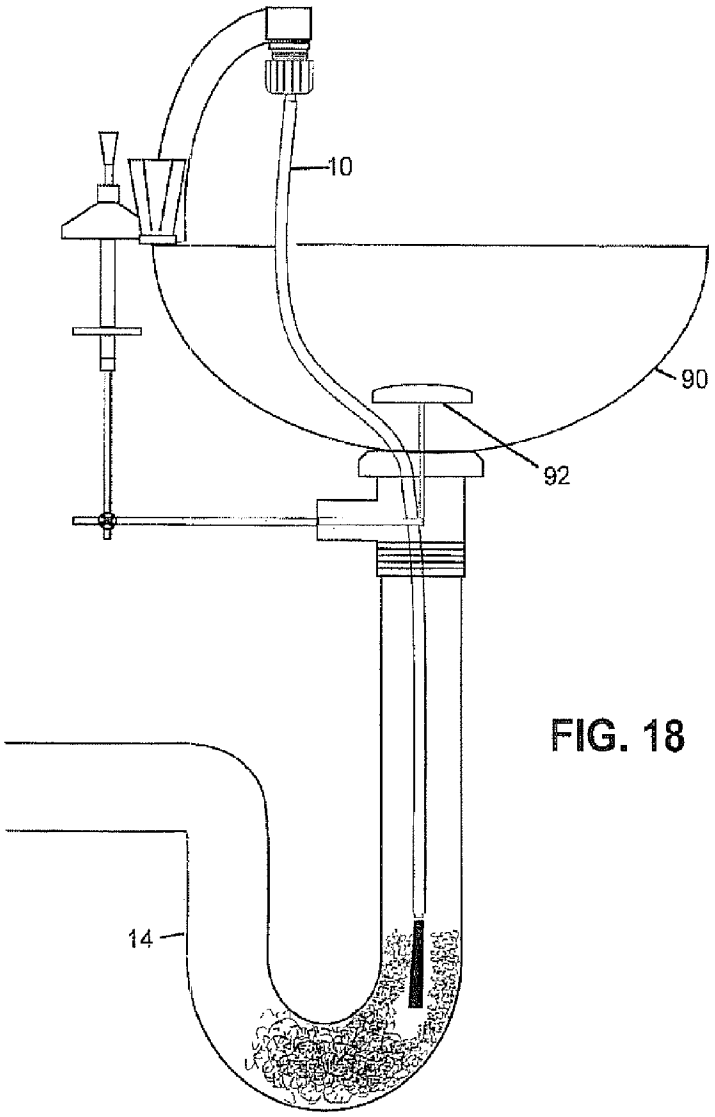
FIG. 18 is a cross-sectional view of the plumbing trap flushing device of the present invention used in a pop up drain in a basin.
Figure 22:
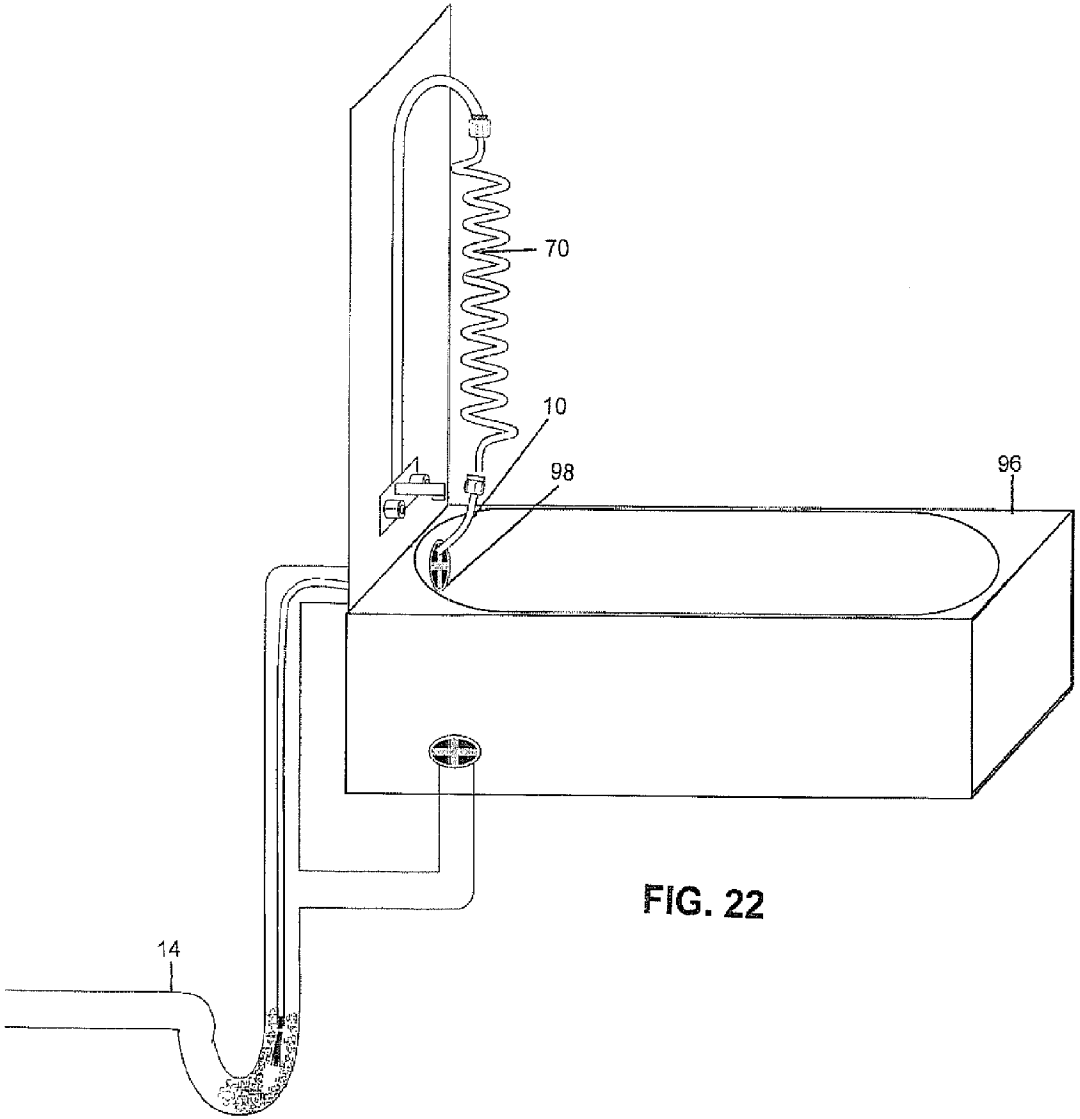
FIG. 22 is a partial perspective view of the plumbing trap flushing device use in an overflow drain in a tub.
Figure 23:
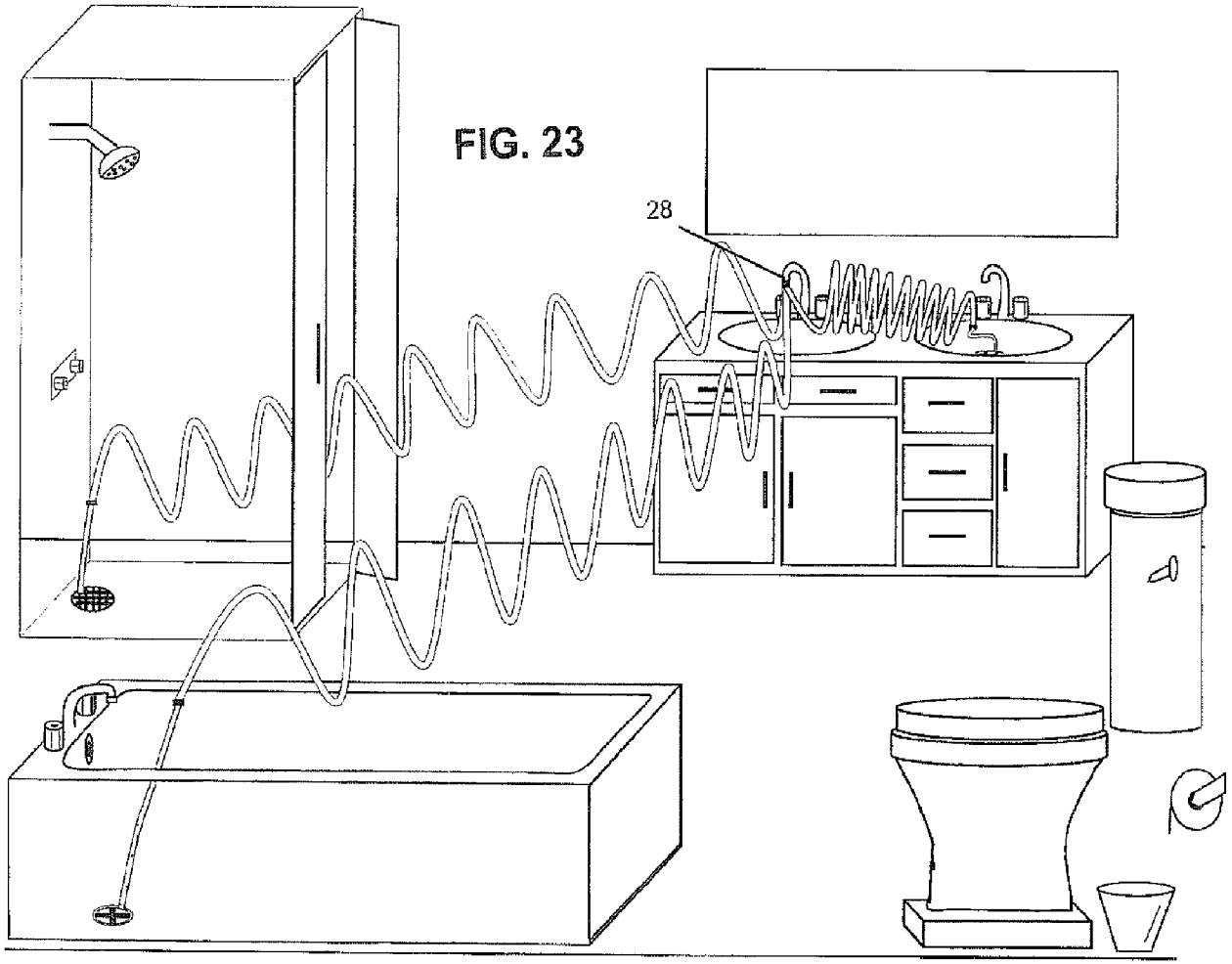
FIG. 23 is an overview of the alternative uses of the plumbing trap flushing device of the present invention as it may be used in a bathroom and attached to a tap of a basin.
Figure 24:
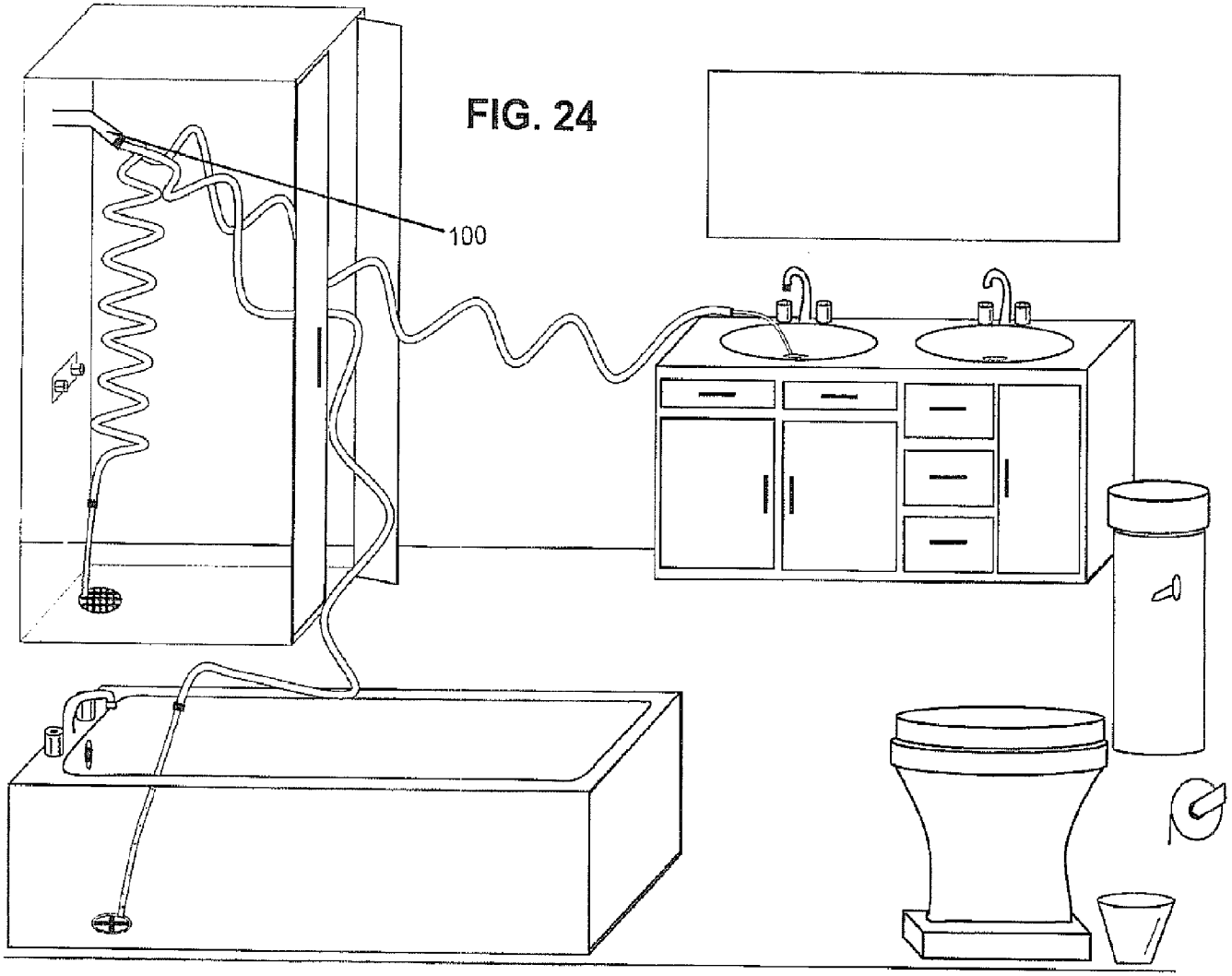
FIG. 24 is an overview similar to that shown in FIG. 23 but showing the plumbing trap flushing device attached to a shower arm.
Figure 25:
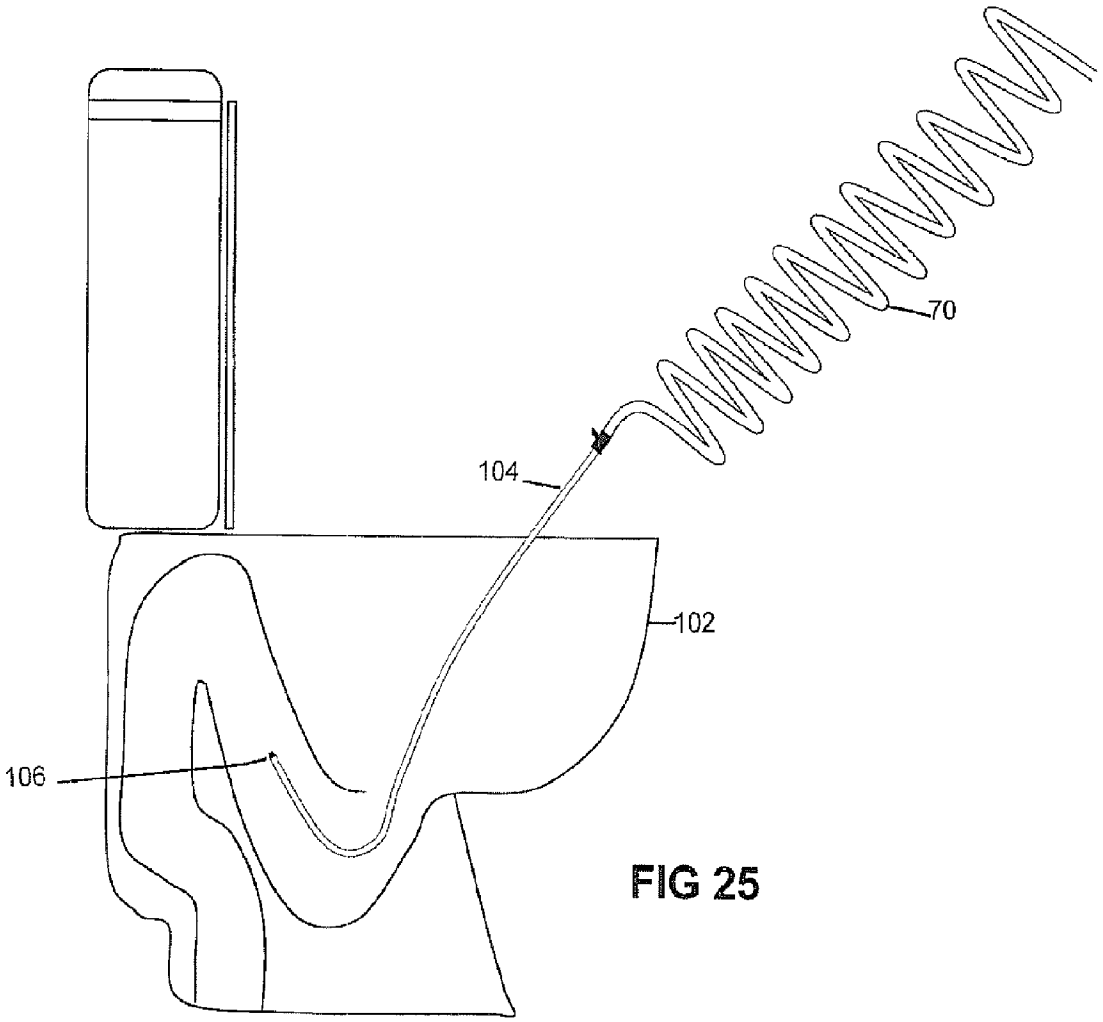
FIG. 25 is a cross sectional view of a toilet flushing device.

As has been shown herein the plumbing trap flushing device may be used in a number of applications throughout the house. Some of these applications are illustrated in the figures herein. Specifically FIG. 15 shows the trap flushing device 10 with the nozzle 38 attached thereto and used in a conventional bathroom basin 90. FIG. 16 shows the trap flushing device 10 as it breaks up the clog and moves it through the trap 14 and used in a conventional bathroom basin 90. As can be seen the trap flushing device 10 can essentially chase the clog through the trap. As discussed above trap flushing device 10 is dimensioned to be used in a pop-up type drain strainer 92 as shown in FIGS. 17 and 18. Trap flushing device 10 is flexible enough so that it can be pushed around pup-up type drain strainer 92. The drain flushing device 80 may be used in a variety of different applications and it is shown in FIG. 19 in a utility type sink 94. The drain flushing device 80 may also be used with the water supply extension 70. It may be used in a tub 96 as shown in FIG. 21. Alternatively the trap flushing device 10 may be used in association with the water supply extension 70 in a tub 96. The trap flushing device 10 may also be used in the overflow drain 98 as shown in FIG. 22. Examples of how either the plumbing trap flushing device 10 or the plumbing drain flushing device 80 may be attached in a typical bathroom are shown in FIGS. 23 and 24. As shown the devices may be attached to tap 28 (FIG. 23) or shower arm 100 (FIG. 24). As can be seen in FIG. 23 the plumbing trap flushing device may attached to a water supply extension and then to a tap 28 and used alternatively in a basin, a shower or a tub. Similarly as shown in FIG. 24 the plumbing trap flushing device may be attached to a water supply extension and then to a shower arm 100 and used alternatively in a basin, a shower or a tub. It should be noted that while FIGS. 23 and 24 show the plumbing trap flushing device use in different devices this is by way of example only and the plumbing trap flushing device would only be used in one device at a time. As well the device may be adapted to be used in a toilet 102 as shown in FIG. 25. The toilet flushing device 104 works the same way as the device described above but the dimensions might vary. As well, most householders would likely use a separate device exclusively for the toilets.

It will be appreciated by those skilled in the art that the elements of this invention may be made with a wide variety of materials and in a wide variety of dimensions while still staying within the parameters described herein. For example the outside diameter of the flexible conduit 20 of the plumbing trap flushing device 10 is preferably dimensioned to fit into a pop-up drain. The inside diameters of the conduit 20 and the nozzle 22 of the plumbing trap flushing device 10 are chosen such that from the tap to the nozzle the inside diameter decreases at each stage. Similarly, the inside diameters of the conduit 81 and the nozzle 62 of the plumbing drain flushing device 80 are chosen such that from the tap to the nozzle the inside diameter decreases at each stage. As well, the inside diameters of the conduit and the nozzle of the toilet flushing device 104 are chosen such that from the tap to the nozzle the inside diameter decreases at each stage. The inside diameter of the water supply extension 70 is chosen such that the inside diameter is equal to or less than the inside diameter of the tap and greater than the insider diameter of the conduit of the trap flushing device 10 and/or the drain flushing device 80 and/or the toilet flushing device 104. Accordingly the outside diameter and inside diameter of each device may vary greatly however typically one would chose from material that are readily available. The following sizes are by way of example only. The inside diameter of the conduit 20 is dimensioned to be as large as possible when considering the constraint of the outside diameter. The outside diameter of the nozzle 22 is chosen so as to be no greater than the outside diameter of the conduit 20 to minimize the chance of the nozzle snagging on debris and the like in the clog. The inside diameter of the nozzle is dimensioned to be smaller than the inside diameter of the conduit and is chosen to maximize the pressure of the stream. It will be appreciated by those skilled in the art that by varying the inside diameter of the nozzle relative to the inside diameter of the conduit the pressure of the stream will vary. However, dimensions of the inside of the nozzle should be balanced against the wall thickness of the conduit 20 which would have a maximum pressure that it could withstand. The length of the conduit 20 will also impact on the pressure at the nozzle 22 That is, the longer the conduit, the lower the pressure at the tip. It has been found that for most applications preferably the conduit 20 is no longer than 36 inches and where the conduit is sold with a water supply extension the conduit 20 is preferably 24 inches. The preferred dimensions for the plumbing trap flushing device 10 are an outside diameter of 0.250 inches and an insider diameter of the 0.187 inches. The nozzle 22 preferably has an outside diameter of 0.245 inches, an inside diameter of 0.125 inches and is 0.800 inches long. Preferably the trap flushing device is approximately 36 inches long. However, if the plumbing trap flushing device 10 is sold as part of kit in association with a water supply extension 70 then the preferred length is 24 inches. The plumbing drain flushing device 80 preferably has an outside diameter of 0.375 inches and an inside diameter of 0.250 inch and a length of approximately 9 inches. The nozzle 62 for the drain flushing device 80 has an outside diameter of 0.310, an inside diameter of 0.155 and is 1.60 inches long. The plumbing drain flushing device 80 would typically be sold as part of a kit with the water supply extension 70. Preferably the toilet flushing device 104 has an outside diameter of 0.375, an inside diameter of 0.250 and has a length of 24 inches. The nozzle 106 has an outside diameter of 0.310 and an inside diameter of 0.155 inches and a length of 1.60 inches. Alternatively the toilet flushing device 104 has an outside diameter of 0.438 inches, an inside diameter 0.375 and a length of 24 inches. The nozzle 106 has an outside diameter of 0.435, and inside diameter of 0.155 and a length of 1.6 inches. Water supply extension 70 preferably has an outside diameter of 0.500 inches and an inside diameter of 0.375 inches and is approximately 15 feet in length. It will be appreciated by those skilled in the art that the outside diameter, inside diameter and length may change while still remaining within the scope of this invention. Preferably the conduits are made from polyethylene tubing, however EVA (Ethyl Vinyl Acetate), PVC (Polyvinyl Chloride), Nitrile, rubber, etc. could also be used.

It will be appreciated by those skilled in the art that the trap flushing device 10, universal connector 32, water supply extension 70, the drain flushing device 80 and the toilet flushing device 104 may be sold separately or as a kit.

Generally speaking, the systems described herein are directed to plumbing trap flushing devices. As required, embodiments of the present invention are disclosed herein. However, the disclosed embodiments are merely exemplary, and it should be understood that the invention may be embodied in many various and alternative forms. The Figures are not to scale and some features may be exaggerated or minimized to show details of particular elements while related elements may have been eliminated to prevent obscuring novel aspects. Therefore, specific structural and functional details disclosed herein are not to be interpreted as limiting but merely as a basis for the claims and as a representative basis for teaching one skilled in the art to variously employ the present invention. For purposes of teaching and not limitation, the illustrated embodiments are directed to plumbing trap flushing device.

As used herein, the term "comprises" and "comprising" are construed as being inclusive and opened rather than exclusive. Specifically, when used in this specification including the claims, the terms "comprises" and "comprising" and variations thereof mean that the specified features, steps or components are included. The terms are not to be interpreted to exclude the presence of other features, steps or components.

What is claimed as the invention is:

1. A plumbing trap flushing device for use with one of a drain in a sink, an overflow drain in a basin, a drain in a bathtub, an overflow drain in a bathtub and the like, the drain having an affixed flanged strainer and a trap, and the flushing device having two opposite ends, comprising:

a first end having a connector releasably attachable to a tap;

a bendable conduit in flow communication with the connector and having an outside diameter; and a second end having a nozzle in flow communication with the distal end of the conduit, the nozzle having a nozzle inside diameter less than the inside diameter of the bendable conduit, the nozzle having a nozzle body, a proximal end and a distal end relative to the nozzle body whereby the water exits the distal end of the nozzle in a stream, wherein the nozzle has a nozzle outside diameter along entire lengths of the nozzle body from the nozzle proximal end to the distal end, the nozzle outside diameter along said entire lengths of the nozzle body being no greater than the outside diameter of the bendable conduit;

wherein the bendable conduit and the second end of the flushing device are dimensioned to fit through the affixed flanged drain strainer and down into the trap without sealing engagement with the trap such that in use, air and water freely flow around the bendable conduit and nozzle into and out of the drain.

2. The plumbing trap flushing device as claimed in claim 1 wherein the connector is a universal connector.

3. The plumbing trap flushing device as claimed in claim 2 further including a water supply extension attachable to the connector and having a connector releasably attachable to a tap.

4. The plumbing trap flushing device as claimed in claim 3 wherein the plumbing trap flushing device and the water supply extension are sold as a kit and the kit further includes a plumbing trap flushing device having a bendable conduit, a nozzle and a connector.

5. The plumbing trap flushing device as claimed in claim 4 wherein the outside diameter of the bendable conduit of the drain flushing device is 0.375 inches and the inside diameter is 0.250 inches.

6. The plumbing trap flushing device as claimed in claim 4 wherein the inside diameter of the nozzle of the drain flushing device is 0.155 inches.

7. The plumbing trap flushing device as claimed in claim 6 wherein the tap has an inside diameter and the inside diameter of the water supply extension is chosen to be equal to or less than the inside diameter of the tap, the inside diameter of the bendable conduit of the toilet flushing device is chosen to be less than the inside diameter of the water supply extension and the inside diameter of the nozzle of the toilet flushing device is chosen to be less than the inside diameter of the bendable conduit.

8. The plumbing trap flushing device as claimed in claim 4 wherein the kit further includes a toilet flushing device.

9. The plumbing trap flushing device as claimed in claim 8 wherein the outside diameter of the toilet flushing device is 0.375 inches and the inside diameter is 0.250 inches.

10. The plumbing trap flushing device as claimed in claim 9 wherein the inside diameter of the toilet flushing device is 0.155 inches.

11. The plumbing trap flushing device as claimed in claim 8 wherein the inside diameter of the toilet flushing device is 0.155 inches.

12. The plumbing trap flushing device as claimed in claim 8 wherein the outside diameter of the toilet flushing device is 0.438 inches and the inside diameter is 0.375 inches.

13. The plumbing trap flushing device as claimed in claim 4 wherein the tap has an inside diameter and the inside diameter of the water supply extension is chosen to be equal to or less than the inside diameter of the tap, the inside diameter of the bendable conduit of the drain flushing device is chosen to be less than the inside diameter of the water supply extension and the inside diameter of the nozzle of the drain flushing device is chosen to be less than the inside diameter of the bendable conduit.

14. The plumbing trap flushing device as claimed in claim 3 wherein the outside diameter of the water supply extension is 0.500 inches and the inside diameter is 0.375 inches.

15. The plumbing trap flushing device as claimed in claim 3 wherein the tap has an inside diameter and the inside diameter of the water supply extension is chosen to be equal to or less than the inside diameter of the tap, the inside diameter of the bendable conduit is chosen to be less than the inside diameter of the water supply extension and the inside diameter of the nozzle is chosen to be less than the inside diameter of the bendable conduit.

16. The plumbing trap flushing device as claimed in claim 2 wherein the connector further includes a connector adaptor and a connector insert.

17. The plumbing trap flushing device as claimed in claim 16 wherein the connector adaptor and the connector insert are configured for connection to different sized taps and bendable conduits.

18. The plumbing trap flushing device as claimed in claim 1 wherein the outside diameter of the bendable conduit is 0.250 inches and the inside diameter is 0.187 inches.

19. The plumbing trap flushing device as claimed in claim 18 wherein the inside diameter of the nozzle is 0.125 inches.

20. The plumbing trap flushing device as claimed in claim 19 wherein the bendable conduit is one of 36 inches long and 24 inches long.

21. The plumbing trap flushing device as claimed in claim 1 wherein the drain flushing device is adapted to hook onto an affixed drain strainer.

22. The plumbing trap flushing device as claimed in claim 1 wherein plumbing trap flushing device is used for cleaning a toilet.

23. The plumbing trap flushing device as claimed in claim 1 wherein the tap has an inside diameter and the inside diameter of the bendable conduit is chosen to be less than the inside diameter of the tap and the inside diameter of the nozzle is chosen to be less than the inside diameter of the bendable conduit.

* * * * *